US005951154A

United States Patent [19]

Carel et al.

[11] Patent Number: 5,951,154

[45] Date of Patent: Sep. 14, 1999

[54] ILLUMINATING BOX-SHAPED PLANTER WITH LIGHT ASSEMBLY, LIGHT ELEMENT CHANNEL, AND GLASS PANEL FOR MULTIDIRECTIONAL LIGHTING

[76] Inventors: Judith M Carel, 724 1/2 N. 11th ; Robert B. Siperly, 2975 E. Riverview Dr., both of Couer d'Alene, Id. 83814

[21] Appl. No.: 08/950,088

[22] Filed: Oct. 14, 1997

[51] Int. Cl.[6] ..... F21S 1/10

[52] U.S. Cl. ..... 362/431; 362/122; 362/127; 362/134; 362/154; 362/249; 362/235; 362/153; 362/153.1; 362/805

[58] Field of Search ..... 362/122, 127, 362/134, 154, 805, 235, 249, 153, 153.1

[56] References Cited

U.S. PATENT DOCUMENTS

| | | | |
|---|---|---|---|
| D. 242,941 | 1/1977 | Nagata | D48/20 |
| 2,674,687 | 4/1954 | Priebe | 362/134 |
| 3,030,735 | 4/1962 | Bodkins | 47/39 |
| 3,109,596 | 11/1963 | Chernansky | 362/134 |
| 3,676,953 | 7/1972 | Delogne | 47/38.1 |
| 4,212,134 | 7/1980 | Brokamp | 47/82 |
| 4,349,864 | 9/1982 | Smith | 362/122 |
| 4,594,646 | 6/1986 | Von Kohorn | 362/101 |
| 4,595,094 | 6/1986 | Reid | 206/45.14 |
| 4,626,968 | 12/1986 | Von Kohorn | 362/122 |
| 4,646,209 | 2/1987 | Jansen | 362/122 |
| 4,753,036 | 6/1988 | Konno | 47/59 |
| 4,758,934 | 7/1988 | von Kohorn | 362/145 |
| 4,796,383 | 1/1989 | Inoue et al. | 47/73 |
| 4,845,602 | 7/1989 | Lehocki | 362/122 |
| 4,847,741 | 7/1989 | Boettinger | 362/431 |
| 4,858,085 | 8/1989 | Von Kohorn | 362/122 |
| 4,951,181 | 8/1990 | Phillips | 362/134 |
| 4,980,807 | 12/1990 | von Kohorn | 362/122 |
| 5,741,061 | 4/1998 | Lehmann et al. . | |

*Primary Examiner*—Sandra O'Shea
*Assistant Examiner*—Ronald E. Delgizzi
*Attorney, Agent, or Firm*—David S. Thompson

[57] ABSTRACT

A lighted planter includes a lighting assembly removably supported on the upper rim of a planter box. The planter box is sized to contain a flower or plant pot. The lighting assembly provides nested inner and outer frames, separated by an array of stained glass panels, defining a channel containing a wrap-around lighting element.

4 Claims, 3 Drawing Sheets

ILLUMINATING BOX-SHAPED PLANTER WITH LIGHT ASSEMBLY, LIGHT ELEMENT CHANNEL, AND GLASS PANEL FOR MULTIDIRECTIONAL LIGHTING

CROSS-REFERENCES

There are no applications related to this application filed in this or any foreign country.

BACKGROUND

Lighted planters and plant stands are known, each type having a number of different structures which provide various advantages and disadvantages. The use of spot lights, ceiling lights and track lights tend to provide illumination, but often do not interact advantageously with the plant and planter. This type of lighting tends to create glare, and tends to be overly directed at certain areas, while leaving other areas comparatively dark.

In response to these issues, it is known to combine a light source and a plant holder or flower pot. Such a combination has certain advantages; e.g. the light source is adjacent to the plant, and therefore more efficiently illuminates the plant. However, a significant problem seen in the prior art where such a combination is provided is that heat from the light source adversely affects the plant, drying both the plant and the potting soil.

Another problem that has not been fully addressed by the prior art is the issue of providing a filtered light that is softened and diffused. This is particularly important, since most illumination systems will be used during the night or at dusk or twilight. In such an environment, a filtered light is preferable. However, few prior art lighted planters have provided structures to filter the light that have not had flaws, such as heat containment and buildup.

Additionally, where many planters are used outside, on decks, walkways and patios, it is increasingly important that the lighted planter serve as a night light capable of providing sufficient light for a person to see to move about without additional illumination. However, prior illuminated planters have tended to direct light upwardly or downwardly into the plant; they have not directed light both up, into the plant, and down, to guide people walking about a deck, patio or walkway.

What is needed is a lighted planter that provides a filtered light upwardly, into the plant, and downwardly, to guide passersby. The lighted planter should be adaptable for use with planters, both inside and outside buildings and houses, and should be sufficiently removed from the plant that heat buildup is not a problem.

SUMMARY

The present invention is directed to an apparatus that satisfies the above needs. A novel lighted planter disclosed provides a filtered light in several directions, and that is sufficiently ventilated to prevent heat buildup problems.

A preferred version of the lighted planter of the present invention provides:

(A) A lighting assembly that is removably carried by the upper rim of a planter box which in turn carries a potted plant. In a preferred embodiment, the lighting assembly provides some or all of the below structures.

(a) An inner frame is formed from four connected inner frame elements. In one embodiment, one of the inner frame element defines an electric cord passage, which allows the lighting element electric cord to pass from a partially enclosed lighting element channel, through the inner frame, and into the planter box.

(b) A supporting shoulder is carried by the inner frame, and allows the lighting assembly to be supported on the upper rim of the sidewalls of the planter box. Typically, the supporting shoulder is formed from four shoulder elements, each of which is carried by one of the inner frame elements.

(c) A lighting element, typically carried by the inner frame in a lighting element channel, between the inner and outer frames. An electric cord, attached to the lighting element, passes under or through an inner frame element, downwardly through the planter box, and out the electric cord hole in a lower portion of the planter box.

(d) An outer frame is formed from four connected outer frame elements. The outer frame has perimeter length greater than a perimeter length defined by the inner frame. As a result, the outer frame and the inner frame define a lighting element channel between them.

(e) Four diagonal connecting pieces, each attached to both the inner and outer frames, form a rigid connection between the inner and outer frames.

(f) Glass panels, carried between the inner frame and outer frame, and frequently in-set into the outer frame, filter light from the lighting element.

(B) A planter box assembly supports the lighting assembly and is sized to contain a flower or plant pot. In a preferred embodiment, the planter box provides:

(a) A plurality of connected box sidewalls forms an upper rim sized to carry the supporting shoulder of the lighting assembly.

(b) A bottom surface, attached to the sidewalls, contains and supports a flower or plant pot.

(c) At least three wheels, carried by the bottom surface, allow the planter box to be rolled about.

It is therefore a primary advantage of the present invention to provide a novel lighted planter having a lighting assembly that is removably carried by the upper rim of a planter box.

Another advantage of the present invention is to provide a lighted planter having a an esthetic appearance associated with a lighting element that creates a diffused light, filtered by glass or stained glass panels.

A still further advantage of the present invention is to provide a lighted planter having a lighting assembly that provides light in both an upward direction and a downward direction, thereby illuminating both a plant carried by the lighted planter and a walkway, patio or other area.

DRAWINGS

These and other features, aspects, and advantages of the present invention will become better understood with regard to the following description, appended claims, and accompanying drawings where:

DESCRIPTION

Figure 1:
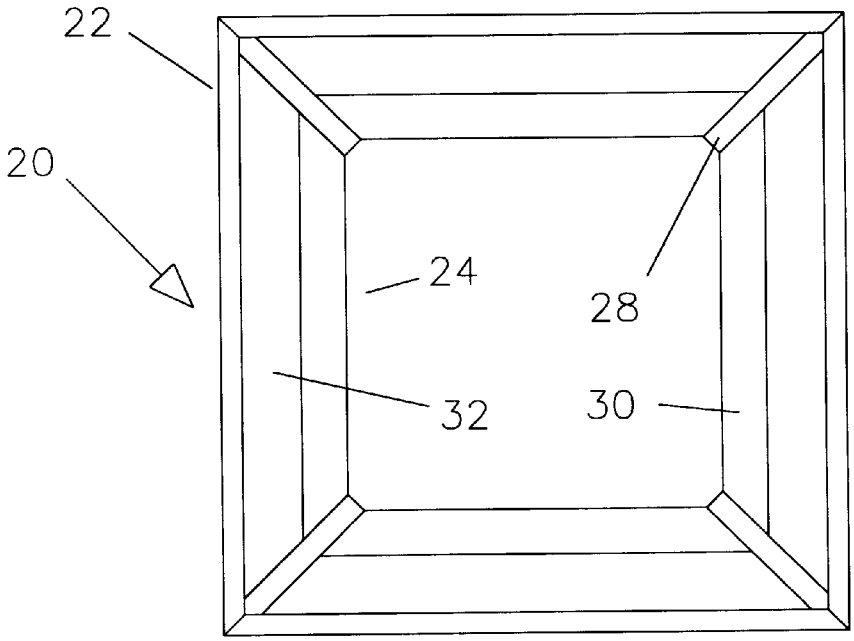
FIG. 1 is a top plan view of the lighting assembly of a version of the invention.

Referring generally to FIGS. 1–6, a lighted planter constructed in accordance with the principles of the invention is seen. The lighted planter includes a planter box 60 supporting lighting assembly 20. The planter box 60 is sized to contain a flower or plant pot 100. The lighting assembly provides nested inner and outer frames, separated by an array of stained glass panels 32 defining a lighting element channel 44 containing a lighting element 36. In the preferred embodiment seen in FIG. 6, the lighting assembly sized to fit the planter box on which it is carried.

The outer frame 22 is typically constructed of four outer frame elements 23, which in the preferred embodiment of the invention are made of furniture quality wood, such as oak, cherry or other hardwood. The size of the outer frame 22 is determined in part by the size of the planter box. In a preferred embodiment, each outer frame element is approximately 22 inches long, 2.5 inches in height and ¾ inch thick.

The inner frame 24 is typically constructed of four inner frame elements 25, which are preferably made of the same material used to construct the outer frame. The size of the inner frame 24 is determined primarily by the size of the planter box. In a preferred embodiment each inner frame element is approximately 17 inches long, 2.5 inches in height and ¾ inch thick.

Figure 5:
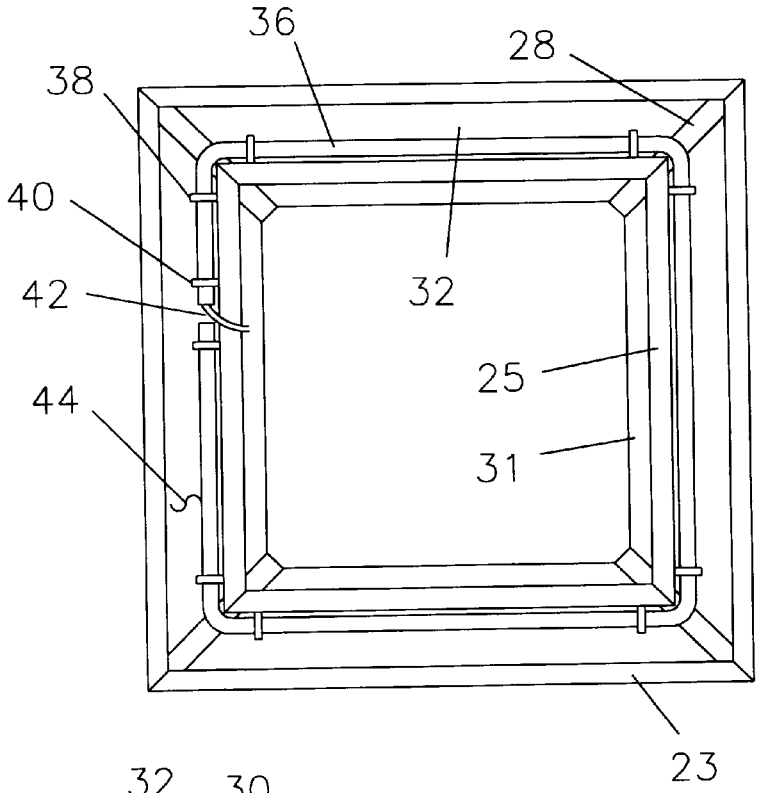
FIG. 5 is a bottom isometric view of the lighting assembly of a preferred embodiment of the invention.
Figure 6:
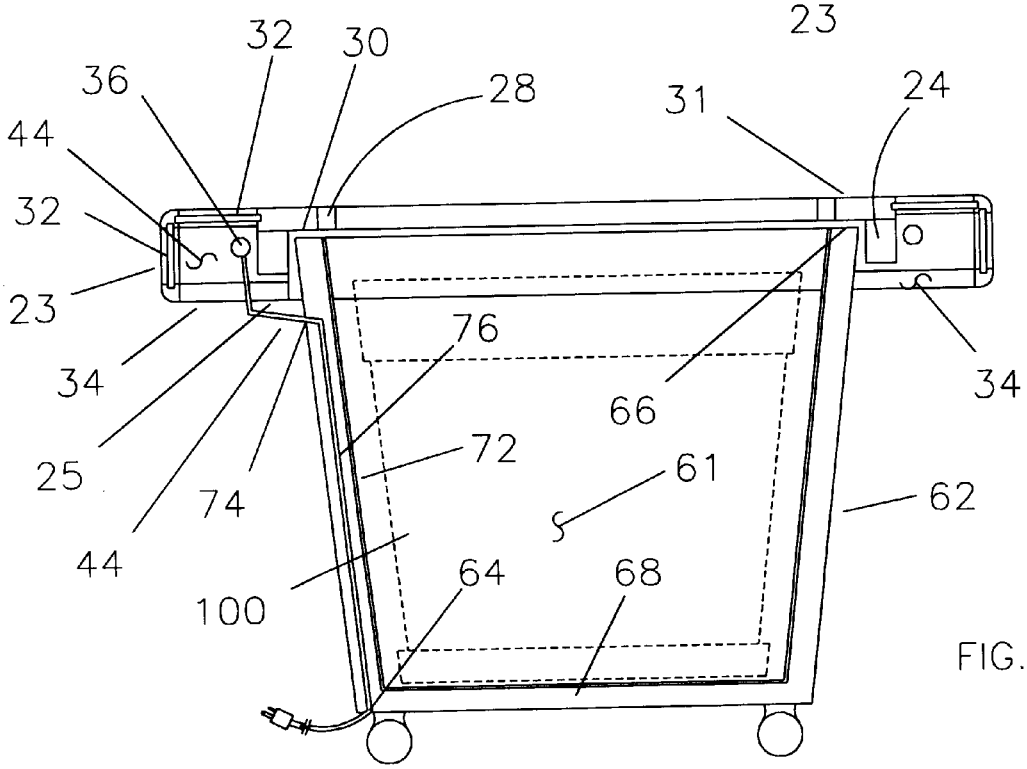
FIG. 6 is a cross-sectional view of the lighting assembly of FIG. 5, showing both the lighting assembly and planter box.

In a preferred version of the invention, seen in FIGS. 5 and 6, the electric cord 42 extends from the lighting element 36, through the open light passageway 34, and into an upper electric cord hole 74 in one of the box sidewalls 62 of the planter box 60. The cord then passes through a cord passage channel 76, and out a lower electric cord hole 64.

Figure 2:
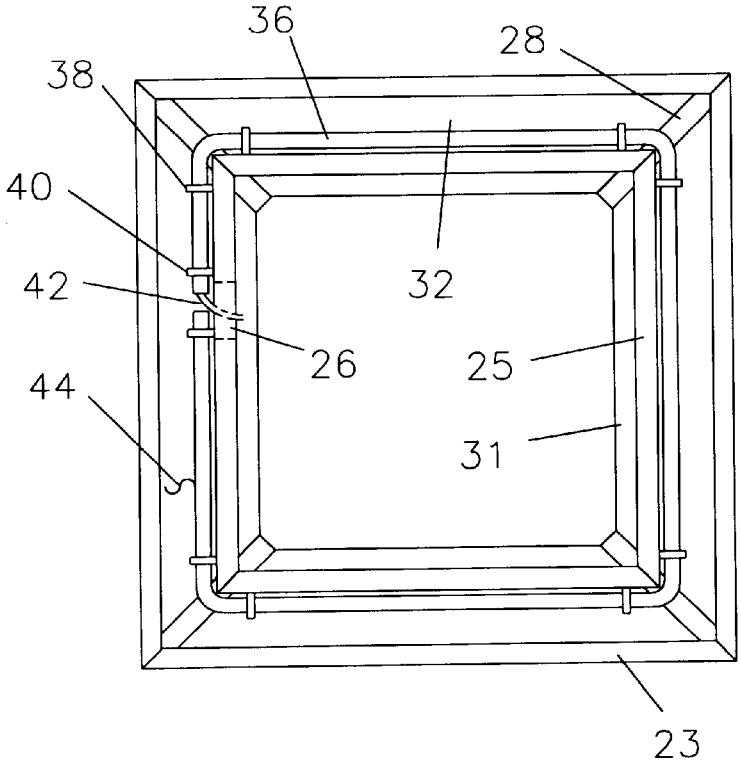
FIG. 2 is a bottom isometric view of the lighting assembly of FIG. 1.
Figure 4:
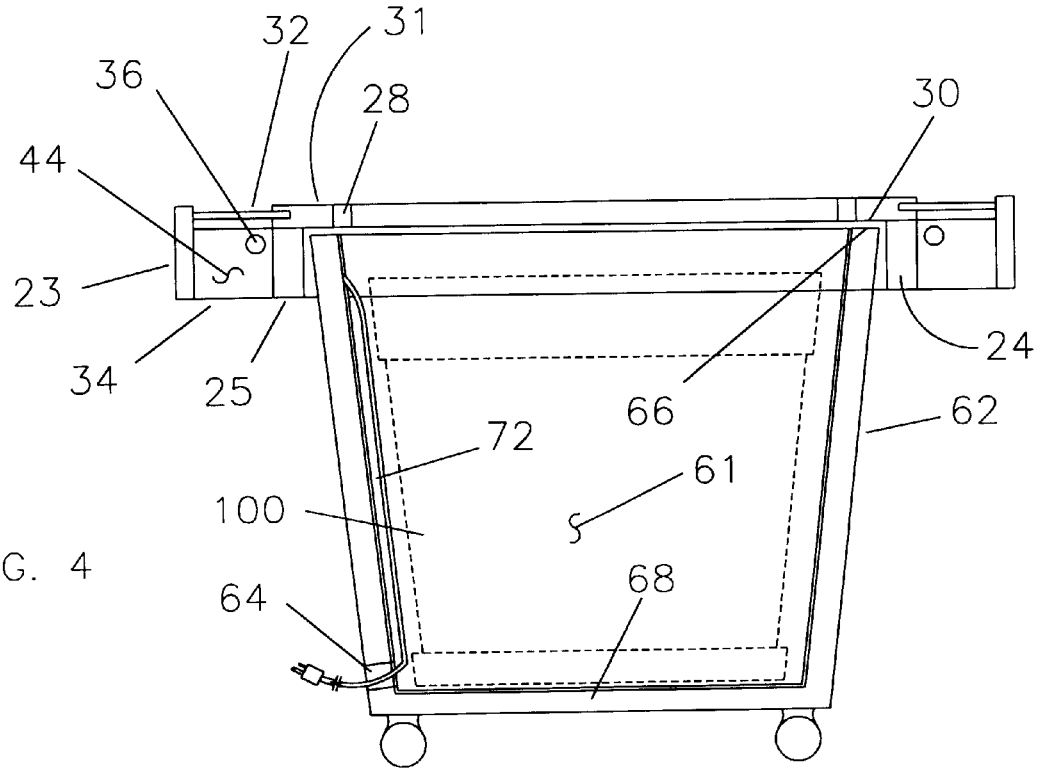
FIG. 4 is a cross-sectional view of the lighted planter of FIG. 3, taken along the 4–4 lines.

In a second version of the invention, seen in FIGS. 2 and 4, an electric cord passage 26, defined in one of the inner frame elements 25, allows an electric cord 42 to pass through the inner frame, from a lighting element 36 to the chamber 61 of the planter box. The electrical cord may be of the type having a switch in-line, within the cord.

As is best seen in the cross-sectional views of FIGS. 4 and 6, a supporting shoulder 30 is carried by the inner frame 24. The supporting shoulder is sized to fit onto the upper rim 66 of the planter box. In the preferred embodiment, the supporting shoulder includes four supporting shoulder elements 31, each element attached to one of the inner frame elements 25.

The inner frame elements are separated by, and connected to, diagonal connecting pieces 28. As seen in FIGS. 1 and 2, the diagonal connecting pieces extend to contact the corners joining the outer frame elements 23. In the preferred embodiment, the diagonal connecting pieces are typically approximately 5.5 inches long, ¾ inch wide and ¾ inch deep, but their exact length is determined by the overall dimensions of the lighting assembly and planter box.

An array of stained glass panels 32 are carried between the inner and outer frames 22, 24. As seen in FIGS. 1, 2, 5 and 6, one version of the invention provides four panels carried between adjacent parallel inner and outer frame elements 25, 23 and diagonal connecting pieces 28.

The stained glass panels 32, and the inner and outer frame elements 25, 23 define a lighting element channel 44 having a lower open light passageway 34. In a preferred embodiment of the invention a stained glass panel is on the upper portion of the channel 44. It is also preferred that the stained glass panels are inset into the outer frame elements 23, as seen in FIG. 6. Additionally, stained glass panels could cover the open light passageway 34, or could be used in any combination in any of the three locations.

While stained glass is used in the preferred embodiment of the invention, other forms of glass or plastic panels having transparent or translucent qualities could be used.

As seen in FIGS. 2, 4, 5 and 6, a lighting element 36 is carried by the inner frame 22, within the lighting element channel 44. The lighting element 36 may be a plurality of fluorescent tubes, Christmas tree-type lights or a fiber optic type light source. However, in the preferred embodiment, the lighting element 36 is a Rope Lite®, of the type now commonly sold in home improvement, hardware and building supply stores. The Rope Lite® provides a flexible tube containing incandescent bulbs at intervals of approximately one inch. The bulbs are protected within the tube, and the entire unit may be replaced, if desired, by removal and replacement of support brackets 38, 40.

As seen in FIGS. 2 and 5, the Rope Lite® 36 is supported on the inner frame elements 25 of the inner frame 24 by eight corner lighting element support brackets 38 and two end lighting element support brackets 40. In the preferred version of the invention, seen in FIGS. 5 and 6, an electric cord 42, extending from one end of the lighting element, passes under the inner frame element 25, and into an upper electric cord hole 74 in the box sidewall 62. The cord passes through a channel 76 and out a lower cord hole 64.

In order to pass the cord through channel 76, it may be necessary to cut the cord, and then feed it through the channel. The cut ends of the cord are then reconnected, typically to the terminals of an in-line switch.

In an alternate version of the invention, seen in FIGS. 2 and 4, an electric cord 42, extending from one end of the lighting element, passes through the passage 26 through an inner frame element 24 into the chamber 61 of the planter box 60.

Figure 3:
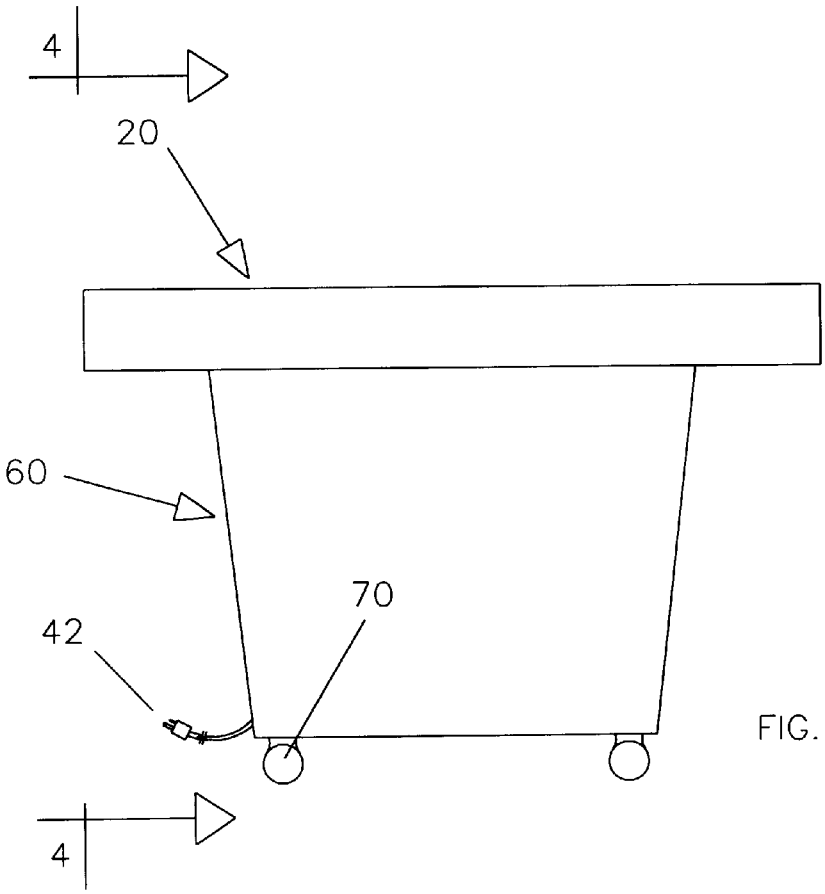
FIG. 3 is a side isometric view of the lighting assembly and planter box of a version of the lighted planter of the invention.

In a preferred embodiment, the planter box 60 is constructed of four sidewalls 62 and a bottom portion 68. These elements define a chamber 61 within which a flower or plant pot 100 may be carried. In a preferred embodiment, the bottom 68 of the planter box 60 carries wheels 70, as seen in FIGS. 3 and 4.

As seen in FIG. 4, the upper rim 66 of the box 60 is sized to fit the supporting shoulder 30, and to thereby support the the lighting assembly.

An optional liner 72, as seen in FIG. 4, may be installed to protect the sidewalls 62 and bottom 68 of the planter box 60. The liner may be made of plastic sheeting or may be of any of a large number of sprayed-on water-proofing materials of a foam, acrylic, plastic or similar nature.

The lighting assembly and planter box are typically constructed of high-quality furniture-grade hard wood. However, they may alternatively be constructed of plastic and wood composite, plastic, plywood, wood veneer, brass, metal, clay or cement, or other material.

In use, a plant pot 100 is placed in the chamber 61 of the planter box 60, which is then wheeled to a desired location. The lighting assembly 20 is placed over the planter box, allowing the upper rim 66 of the planter box to support the supporting shoulder 30 of the lighting assembly. The electric cord 42 is configured, as seen in either FIG. 4 or FIG. 6, and is then plugged into a convenient electrical outlet.

When turned on, the lighting element 36 provides diffused lighting upwardly and optionally sideways, through the stained glass panels 32, and downwardly through the open light passageway 34. The upwardly directed light tends to illuminate a plant carried by the pot 100, while the downwardly directed light tends to illuminate portions of an adjacent walkway, deck or patio.

The previously described versions of the present invention have many advantages, including a primary advantage of providing a novel lighted planter having a lighting assembly that is removably carried by the upper rim of a planter box.

Another advantage of the present invention is to provide a lighted planter having a an esthetic appearance associated with a lighting element that creates a diffused light, filtered by glass or stained glass panels.

A still further advantage of the present invention is to provide a lighted planter having a lighting assembly that provides light in both an upward direction and a downward direction, thereby illuminating both a plant carried by the lighted planter and a walkway, patio or other area.

The invention resides not in any one of these features per se, but rather in the particular combination of all of them herein disclosed and claimed and it is distinguished from the prior art in this particular combination of all of its structures for the functions specified.

Although the present invention has been described in considerable detail and with reference to certain preferred versions, other versions are possible. For example, while a cross-section of the lighted planter of the preferred embodiment perpendicular to a vertical axis is square, a three-sided, five-sided or other poly-sided or round lighted planter could be constructed. Also, while the lighted planter of the preferred embodiment is made of furniture-quality wood, other materials could be used. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A lighted planter, comprising:

(A) a lighting assembly;

(a) an inner frame;

(b) a supporting shoulder, carried by the inner frame;

(c) an outer frame, having a perimeter length greater than a perimeter length defined by the inner frame, defining a lighting element channel between the inner frame and the outer frame having a lower light passageway;

(d) a lighting element, carried within the lighting element channel defined between the inner and and outer frames, (e) connecting means, carried by the inner frame and the outer frame, for forming a rigid connection between the inner and outer frames; and (f) at least one glass panel, carried between the inner frame and outer frame, whereby light from the lighting element may pass through the at least one glass panel; and (B) a planter box, supporting the lighting assembly, the planter box comprising:

(a) a plurality of connected box sidewalls, the connected sidewalls forming an upper rim, the upper rim sized to carry the supporting shoulder of the lighting assembly; and (b) a bottom surface, carried by the sidewalls.

2. The lighted planter of claim 1, further comprising at least three wheels, carried by the bottom surface.

3. The lighted planter of claim 1, in which the connecting means comprises four diagonal connecting pieces, wherein each diagonal connecting piece is attached to both the inner and outer frames.

4. A lighted planter, comprising:

(A) a lighting assembly;

(a) an inner frame, formed from four connected inner frame elements;

(b) a supporting shoulder, carried by the inner frame, formed from four shoulder elements;

(c) an outer frame, formed from four connected outer frame elements, the outer frame having a perimeter length greater than a perimeter length defined by the inner frame, the outer frame and the inner frame defining a lighting element channel between them;

(d) a lighting element, carried within the lighting element channel defined between the inner and and outer frames;

(e) four diagonal connecting pieces, wherein each diagonal connecting piece is attached to both the inner and outer frames, and wherein the diagonal connecting pieces form a rigid connection between the inner and outer frames; and (f) at least one glass panel, carried between the inner frame and outer frame, whereby light from the lighting element may pass through the at least one glass panel; and (B) a planter box, supporting the lighting assembly, the planter box, comprising:

(a) a plurality of connected box sidewalls, one sidewall defining an electric cord hole, the connected sidewalls forming an upper rim the upper rim sized to carry the supporting shoulder of the lighting assembly;

(b) a bottom surface, carried by the sidewalls; and (c) at least three wheels, carried by the bottom surface.

* * * * *